US010429047B2

(12) United States Patent
Galloppa et al.

(10) Patent No.: US 10,429,047 B2
(45) **Date of Patent: *Oct. 1, 2019**

(54) MODULAR LUMINAIRE ASSEMBLIES

(71) Applicant: SCHREDER, Brussels (BE)

(72) Inventors: Sandro Galloppa, Seraing (BE); Gunther Salme, Fleurus (BE)

(73) Assignee: SCHREDER, Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 15/962,191

(22) Filed: Apr. 25, 2018

(65) Prior Publication Data

US 2018/0238530 A1 Aug. 23, 2018

Related U.S. Application Data

(63) Continuation of application No. 15/088,324, filed on Apr. 1, 2016, now Pat. No. 9,976,734.

(30) Foreign Application Priority Data

Apr. 2, 2015 (BE) ..... 2015/5217
Dec. 20, 2015 (EP) ..... 15203041

(51) Int. Cl.
*F21V 23/06* (2006.01)
*F21V 31/00* (2006.01)
(Continued)

(52) U.S. Cl.
CPC ..... *F21V 23/06* (2013.01); *F21S 2/005* (2013.01); *F21S 8/083* (2013.01); *F21V 21/005* (2013.01);
(Continued)

(58) Field of Classification Search
CPC ..... F16B 7/0406; F16B 7/0426
(Continued)

(56) References Cited

U.S. PATENT DOCUMENTS 1,740,957 A 12/1929 Phillips
4,096,379 A 6/1978 Taylor
(Continued)

FOREIGN PATENT DOCUMENTS

DE 8403437 U1 4/1984
DE 10023183 A1 11/2001
(Continued)

OTHER PUBLICATIONS

Belgian Patent Office Search Report dated Sep. 21, 2015 re application of Schreder, No. BE2015/5217.
(Continued)

*Primary Examiner* — Christopher M Raabe
(74) *Attorney, Agent, or Firm* — Patrick J. Daugherty; Daugherty & Del Zoppo Co., LPA

(57) ABSTRACT

Described herein is modular luminaire assembly which is readily assembled and installed in the field whilst providing rigidity, structural integrity and water-tightness. The assembly comprises a plurality of luminaire modules mounted on a supporting pole. The plurality of luminaire modules comprises three luminaire modules which are connected to one another by respective module connectors and to the supporting pole by module connector. Each luminaire module has at least one interface for engaging with a complementary interface of an adjacent luminaire module or the supporting pole to provide a water-tight connection, each pair of modules being fixed together by a module connector.

20 Claims, 6 Drawing Sheets

(51) Int. Cl.

| | |
|---|---|
| ***F21S 2/00*** | (2016.01) |
| ***F21S 8/08*** | (2006.01) |
| ***F21V 21/005*** | (2006.01) |
| ***F21V 21/116*** | (2006.01) |
| *F21W 131/403* | (2006.01) |

(52) U.S. Cl.
CPC ..... *F21V 21/116* (2013.01); *F21V 31/005* (2013.01); *F21W 2131/403* (2013.01)

(58) Field of Classification Search
USPC ..... 362/234
See application file for complete search history.

(56) References Cited

U.S. PATENT DOCUMENTS

| | | | | |
|---|---|---|---|---|
| 4,793,040 | A | 12/1988 | Rumberger | |
| 5,658,066 | A | 8/1997 | Hirsch | |
| 6,384,735 | B1 | 5/2002 | Rabou et al. | |
| 9,845,949 | B2 * | 12/2017 | Feller | H04R 1/028 |
| 9,976,734 | B2 * | 5/2018 | Galloppa | F21V 21/116 |
| 2003/0080531 | A1 | 5/2003 | Ritchey | |
| 2004/0155219 | A1 | 8/2004 | McCarty | |
| 2009/0123994 | A1 | 5/2009 | Lafaye | |
| 2012/0201021 | A1 | 8/2012 | Todd | |
| 2013/0011189 | A1 | 1/2013 | Kamiya | |
| 2014/0268718 | A1 | 9/2014 | Yu | |
| 2015/0198317 | A1 * | 7/2015 | Feller | H05B 33/0842 362/249.01 |
| 2016/0356433 | A1 | 12/2016 | Xu | |
| 2016/0361825 | A1 | 12/2016 | Zanella | |

FOREIGN PATENT DOCUMENTS

| | | | |
|---|---|---|---|
| EP | 0913625 | A3 | 11/2000 |
| EP | 1004815 | A3 | 10/2001 |
| EP | 1623154 | B1 | 8/2006 |

OTHER PUBLICATIONS

European Patent Office Search Report dated Apr. 15, 2016 re application of Schreder, No. EP16161657.8.

* cited by examiner

MODULAR LUMINAIRE ASSEMBLIES

FIELD OF THE INVENTION

The present invention relates to improvements in or relating to modular luminaire assemblies, and is more particularly concerned with the provision of connecting elements for connecting two modules together.

BACKGROUND OF THE INVENTION

Luminaires are well-known for providing lighting for an area in which the luminaire is positioned. Whilst these luminaires are generally considered to comprise a lighting module mounted on a supporting pole, other functionalities can be provided by modules which are also mounted on the supporting pole. Such a luminaire effectively comprises a modular luminaire assembly in which at least one module may be mounted coaxially on the supporting pole. Such a module may have at least one functionality which is unrelated to providing lighting of the area in which the luminaire is positioned.

SUMMARY OF THE INVENTION

It is therefore an object of the present invention to provide a modular luminaire assembly which is easily assembled and installed in the field.

It is another object of the present invention to provide a modular luminaire assembly in which water-tight connections are provided between adjacent luminaire modules.

It is a further object of the present invention to provide a modular luminaire assembly which provides for electrical connections between modules as well as providing passage for cabling through modules.

In accordance with one aspect of the present invention, there is provided a modular luminaire assembly comprising:

at least one luminaire module mountable to at least one other luminaire module, each luminaire module comprising at least one interface formed at an end thereof, each interface having an external surface, the luminaire modules to be mounted to one another comprising complementary interfaces having respective external surfaces, the complementary interfaces being configured for engaging with one another so that their respective external surfaces define a shaped portion;

at least one module connector for connecting two luminaire modules to be mounted to one another, each module connector having an internal surface shaped to be complementary to the shaped portion formed by the external surfaces of the engaged complementary interfaces;

characterized in that the module connector is configured to apply pressure in a first direction when the module connector is tightened against the external surfaces of the engaged complementary interfaces;

and in that the internal surface of the module connector is configured to convert the pressure applied in the first direction to a clamping pressure in a second direction, the second direction being substantially perpendicular to the first direction.

In such a way, a modular luminaire assembly can be provided which has an appropriate structural integrity, accommodates the passage of cabling and other electrical connections whilst providing a water-tight connection between adjacent luminaire modules.

Preferably, at least one interface includes a seal which is engaged by a portion of the associated complementary interface.

The provision of a seal ensures that a water-tight connection is provided which prevents the ingress of water into the modular luminaire assembly.

In one embodiment, the shaped portion formed by the complementary interfaces is symmetrical about a contact plane between the complementary interfaces.

Similarly, the complementary internal surface of each module connector may be symmetrical about a plane through the module connector.

By having a symmetrical shaped portion and a corresponding symmetrical complementary internal surface of the module connector, the module connector may be mounted to the shaped portion in any orientation.

In a preferred embodiment, the shaped portion comprises an annular bi-cone.

By having the external surfaces of the complementary interfaces form an annular bi-cone, the module connector, when tightened, can readily provide a force holding the complementary interfaces together.

Each connector module may further comprise at least one fixing element arranged for clamping together the internal surface of the connector module and the external surfaces of the shaped portion formed by the engaged complementary interfaces of the luminaire modules to be mounted to one another.

Each connector module may comprise first and second connector portions which are held together, around the shaped portion formed by the external surfaces of the complementary interfaces of two luminaire modules to be mounted to one another, by at least two fixing elements passing through one connector portion and into the other connector portion.

In one embodiment, each connector portion has at least one aperture through which a fixing element passes and a hole into which the fixing element engages.

In a preferred embodiment, the first and second connector portions are identical and one of the first and second connector portions is rotatable with respect to the other connector portion to form the connector module and for receiving the fixing elements.

By having identical connector portions which when used in pairs around the shaped portion of the complementary interfaces, costs can be reduced as only one tool is required.

In an alternative embodiment, the first and second connector portions are integrally formed with a flexible hinge located between the two connector portions, the first and second connector portions being held together around the shaped portion formed by the external surfaces of the complementary interfaces by at least one fixing element which passes through one connector portion and into the other connector portion.

By forming the module connector in one piece, a single tool is required for its manufacture and the module connector only needs to be connected at its free ends to enclose the shaped portion formed by the external surfaces of the complementary interfaces.

At least one luminaire module may be mounted to two luminaire modules, each luminaire module comprising first and second interfaces at respective first and second ends thereof, the first and second interfaces comprising complementary interfaces.

Advantageously, the modular luminaire assembly comprises a support module having an interface operable for engaging a complementary interface of a luminaire module.

In one embodiment, the support module may be mountable on a supporting pole having the same diameter as the luminaire modules. In another embodiment, the support module is mountable on a supporting pole having a different diameter to the diameter of the luminaire modules.

By having such a support module, the assembled luminaire modules can readily be mounted on the supporting pole irrespective of its diameter relative to the diameter of the luminaire modules.

In accordance with another aspect of the present invention, there is provided a luminaire comprising:

at least one luminaire module having a light-related function and including at least a first interface having an external surface;

at least one other luminaire module including at least a second interface, the second interface being complementary to the first interface and having an external surface, the at least one other luminaire module comprising one of: an additional light engine module, a non-lighting related module, and an empty module, the complementary interfaces being operable for engaging with one another so that their respective external surfaces define a shaped portion;

at least a module connector for connecting the two luminaire modules to be mounted to one another, each module connector having an internal surface shaped to be complementary to the shaped portion formed by the external surfaces of the engaged complementary interfaces;

characterized in that the module connector is configured to provide an applied pressure in one direction when the connector module is tightened to the two luminaire modules mounted to one another, and in that the shaped portion formed by the external surfaces of the engaged complementary interfaces is configured in such a way that the applied pressure is converted to a clamping pressure for the two luminaire modules in a direction substantially perpendicular to the direction of the applied pressure.

BRIEF DESCRIPTION OF THE DRAWINGS

For a better understanding of the present invention, reference will now be made, by way of example, to the accompanying drawings in which.

DESCRIPTION OF THE INVENTION

Figure 1:
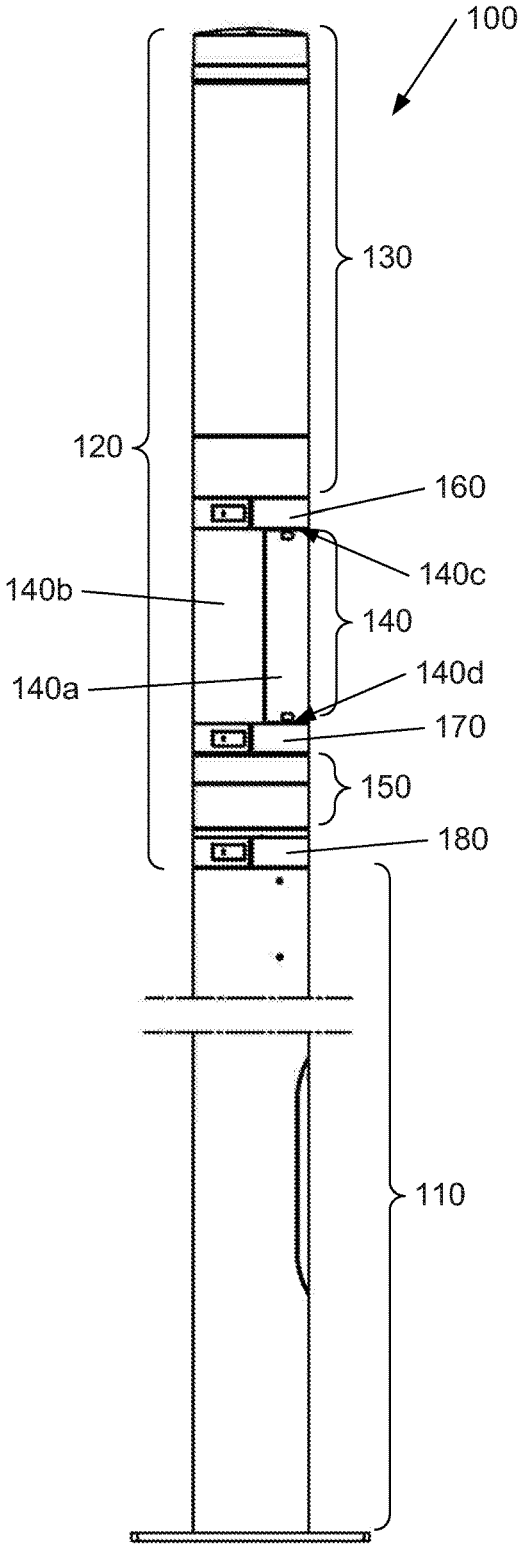
FIG. 1 illustrates a side view of a supporting pole of a luminaire assembly in accordance with the present invention.

Whilst a supporting pole can be designed to have the appropriate structural integrity to support the lighting module, particularly when such a pole is made as a single component, it may be difficult to connect supplemental modules together to meet the structural integrity requirements when the pole has a modular configuration. In addition, any connection component needs to enable the passage of cabling for the lighting module (and for the supplemental modules if required) there through. Moreover, a water-tight connection needs to be provided between adjacent modules.

EP-B-1623154 discloses a lighting fixture which comprises at least two lighting modules which can be joined together and mounted on a supporting pole. The lighting pole defines an axis about which each lighting module can be rotatable with respect to an adjacent lighting module so that light can be directed in different directions around the axis. Each module comprises first and second interfaces located at respective first and second ends of the module, the first interface of one module being connectable to the second interface of another module. A passageway is provided in each module which extends from the first end to the second end and which can be aligned with a passageway of at least one another module so that cabling etc. can be passed to modules which are remote from the supporting pole above other modules. The interfaces are secured together by a plurality of screws which are located in the second interface and which engage corresponding threaded portions provided in the first interface of an adjacent module.

Whilst the lighting fixture described in EP-B-1623154 allows the passage of cabling through each lighting module, it is not necessarily water-tight and water may penetrate the lighting modules at their interfaces. In addition, it may be time-consuming to assemble such a lighting fixture in the field as it may be difficult to provide correct alignment of the lighting modules so that the screws in the second interface can enter the correct threaded portions in the first interface. The present invention will be described with respect to particular embodiments and with reference to certain drawings but the invention is not limited thereto. The drawings described are only schematic and are non-limiting. In the drawings, the size of some of the elements may be exaggerated and not drawn to scale for illustrative purposes.

FIG. 1 illustrates a modular luminaire assembly 100 comprising a supporting pole 110 on which is mounted a plurality of modules 120, each module comprising a casing and effectively forming part of the supporting pole 110. In the illustrated embodiment, the plurality of modules comprises a first luminaire module 130, a second luminaire module 140, and a third luminaire module 150 which are connected to one another by module connectors 160, 170 and to the supporting pole 110 by module connector 180. Module connector 160 connects the first module 130 and the second module 140; module connector 170 connects the second module 140 and the third module 150; and module connector 180 connects the third module 150 to the supporting pole 110 as shown. The operation of the module connectors 160, 170, 180 is described in more detail below.

Each luminaire module 130, 140, 150 preferably comprises passageways (not shown) through which cabling can pass to adjacent modules, for example, coaxial cables would be threaded through luminaire modules as it is expensive to form connections which may create a loss in signal. In addition, each luminaire module may have one or more electrical connectors for providing electrical connections between modules as described below in more detail with reference to FIG. 6.

Figure 2:
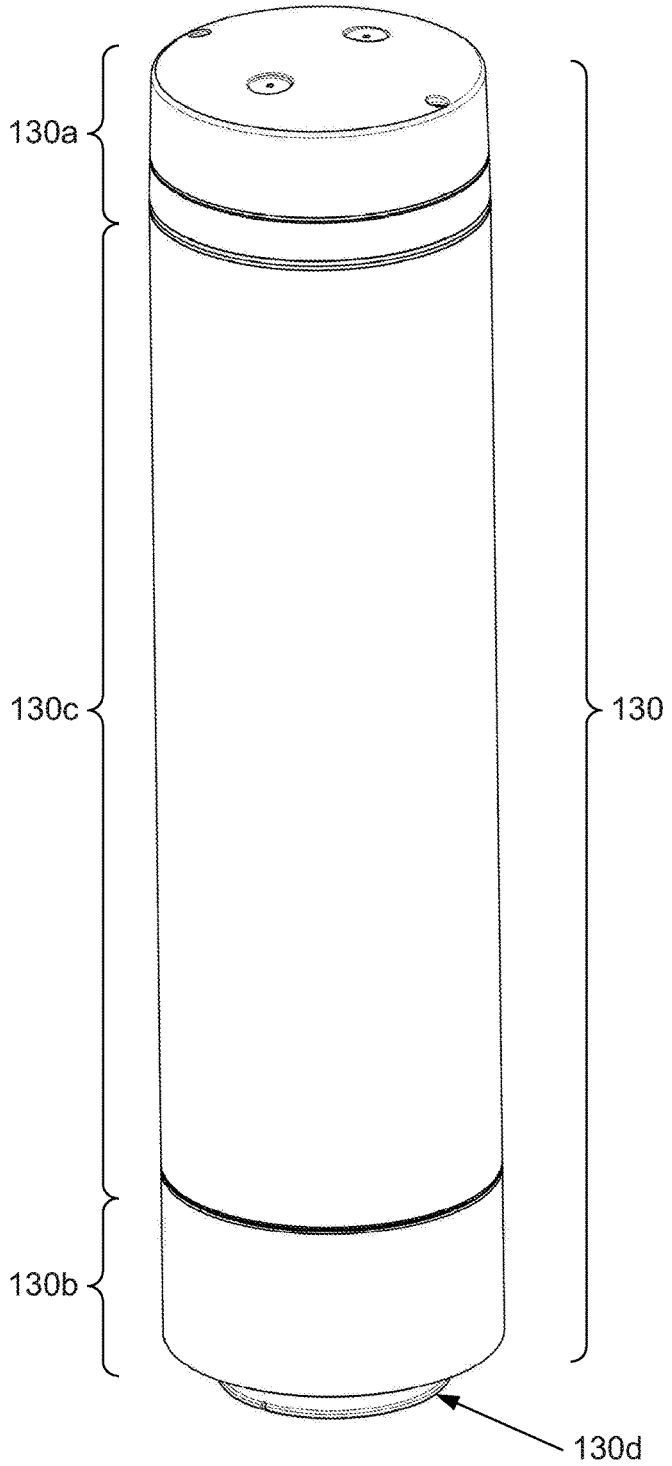
FIG. 2 illustrates a perspective view of a module forming an upper part of the supporting pole shown in FIG. 1.

Module 130 is shown in more detail in FIG. 2. This module forms the uppermost module of the modular luminaire assembly 100, as shown in FIG. 1, as it is the lightest. Module 130 is substantially circular in cross-section and comprises a first (or top or upper) portion 130*a*, a second (or bottom or lower) portion 130*b* which is connectable to another module using a module connector in accordance with the present invention as will be described in more detail below, and a third (or central) portion 130*c* between the first and second portions 130*a*, 130*b*. The second portion 130*b* includes a connector portion 130*d* which is connectable to a corresponding connector portion in another module as will be described in more detail below. The central portion 130*c* may comprise a casing made of a lightweight transparent polymeric material, for example, polycarbonate, and may include a light-emitting diode (LED) array (not shown) for providing light which can be transmitted through the transparent polymeric casing.

Naturally, the type of polymeric material is chosen for its optical properties and for its durability and resistance to ultraviolet (UV) radiation when used in an exterior deployment.

In other embodiments, the polymeric material from which the casing is made may be opaque or transparent, and may also include non-lighting related functions (also not shown), for example, a Wi-Fi transceiver module, a loudspeaker module, one or more camera modules, a video surveillance module, etc. In addition, the material from which the casing is made is not limited to polymeric materials and may comprise any other suitable lightweight and inexpensive material.

The first portion 130*a* may include apertures 135*a*, 135*b* for antennas in accordance with particular use for each modular luminaire assembly. Such antennas are connected to coaxial cabling extending through passageways provided in the supporting pole 110 and in other luminaire modules as described above.

As described above, the second portion 130*b* includes a connector portion or interface 130*d* which engages a complementary connector portion or interface (not shown) provided in module 140 as will be described in more detail below, and which is held together by module connector 160.

Module 140 comprises a casing having a substantially circular cross-section but which is divided into a first part 140*a* made of a transparent polymeric material, such as polycarbonate, and a second part 140*b* made of a metallic material, such as aluminium. By having such a division in the casing, light can be directed in a predetermined direction as defined by the angle subtended by the first portion 140*a*. In this case, the module 140 may include an LED array (not shown) which provides light for transmission by the first part 140*b*. As mentioned above, the transparent polymeric material is intended to have particular properties.

For non-lighting related functions, the polymeric material of which the casing is made may be opaque or non-transparent. In addition, the material from which the casing is made is not limited to polymeric materials and may comprise any other suitable lightweight and inexpensive material.

Connector portions or interfaces (not shown) are provided at a first (or top or upper) end 140*c* and at a second (or bottom or lower) end 140*d* as will be described in more detail below with reference to FIGS. 4 to 6. The complementary connector portions or interfaces are held together by module connector 170.

Module 150 may comprise a casing having a substantially circular cross-section in which one or more LED arrays may be provided. Such LED arrays may comprise a single array having LED elements of only one colour, a single array having LED elements of more than one colour, for example, RGB (red/green/blue), which can be switched in one or more predetermined patterns to provide visual effects or for signalling purposes. In this case, the casing may comprise a transparent or semi-transparent material polymeric material through which the light from the LED elements can be transmitted.

Module 150 is mounted to the supporting pole 110 by way of a connector portion or an interface formed at a lower end (or bottom end), as shown in FIG. 1, of the module and a complementary connector portion or interface formed at an upper end (or top end) of the supporting pole 110. The complementary connector portions or interfaces are held together by module connector 180.

Although three luminaire modules and three module connectors are shown in FIG. 1, it will readily be appreciated that any appropriate number of luminaire modules may be mounted on the supporting pole and connected to one another and to the supporting pole by a corresponding number of module connectors.

In addition, at least one luminaire module may have a functionality which is unrelated to the provision of lighting or may have a combination of the lighting-related and lighting-unrelated functionalities as described above.

The modular luminaire assembly may further comprise a support module operable for being mounted on the supporting pole in order to provide an interface allowing the mounting of the modules on top of the supporting pole. Such a support module may be adapted for mounting on either a pole of same diameter as the modules or a pole of different diameter to that of the modules.

Figure 3:
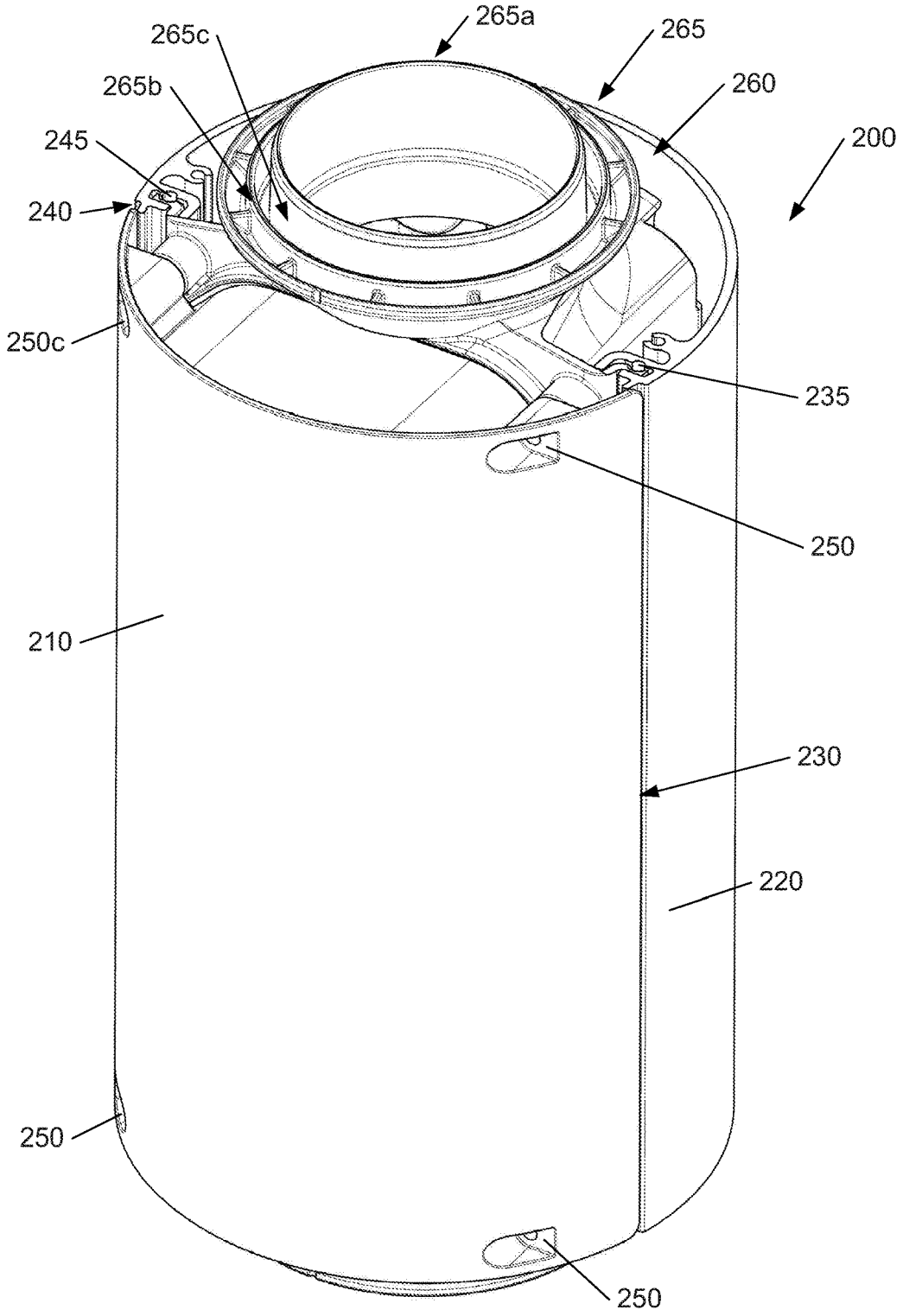
FIG. 3 illustrates, in more detail, a perspective view of a module.

FIG. 3 illustrates a generic luminaire module 200 having two complementary connector portions or interfaces as will be described in more detail below with reference to FIG. 5). Such a generic luminaire module 200 may form any one of the modules 140, 150 as described above with reference to FIG. 1, module 130 only having a single connector portion or interface as it is only connected at one of its ends to another luminaire module.

The module 200 comprises a casing having a substantially circular cross-section which is formed by a first portion 210 and a second portion 220, each having a substantially semi-circular cross-section, connected together along first and second longitudinal seals 230, 240 to form a cylinder having a substantially circular cross-section. (The term "longitudinal" as used herein is intended to refer to any component or element that extends the length of a luminaire module.) Only a top portion of the seam 240 being visible in the Figure. Each longitudinal seal 230, 240 includes a longitudinal gasket- or seal-retaining groove 235, 245 formed as part of an internal component of the module into which a gasket or seal (not shown) is positioned for making the casing water-tight when the first and second portions 210, 220 are secured together by any suitable means, for example, in the illustrated embodiment, by means of screws (indicated generally as 250).

The module 200 has a first end 260 and a second end 270. The first end 260 includes a first interface 265 which is formed by a first annular portion 265*a* having a first diameter, and a second annular portion 265*b*, separated from the first annular portion 265*a* by an annular groove 265*c* (as can be more clearly seen in FIG. 5). The second annular portion 265*b* has a second diameter which is greater than the first diameter and comprises an annular rim portion 265*d* which projects away from an annular shoulder portion 265*e*, the annular shoulder portion having a third diameter which is greater than a fourth diameter of the annular rim portion 265*d*. The first and second annular portions 265*a*, 265*b* are concentric with respect to a longitudinal axis (not shown) of the module 200.

Figure 5:
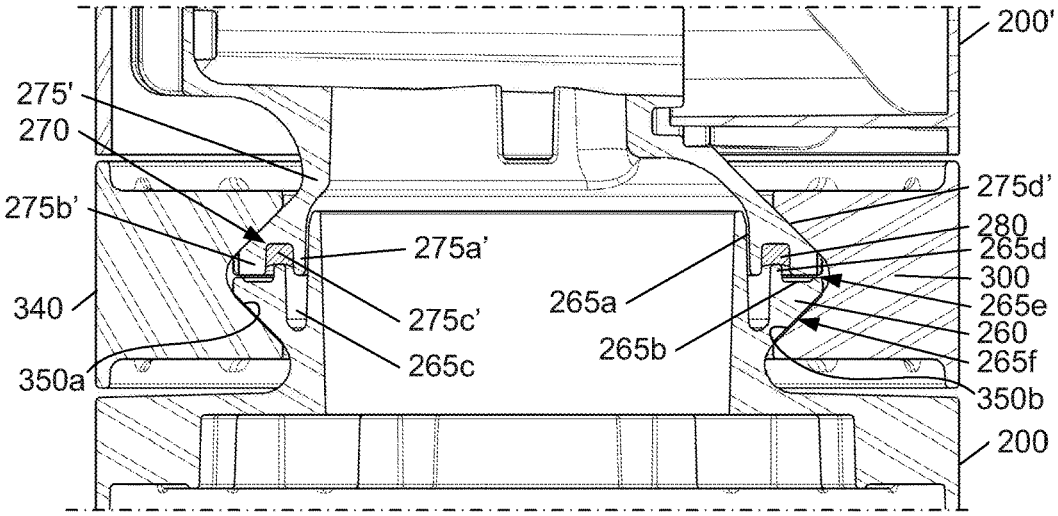
FIG. 5 illustrates a cross-sectional view of a module connector in accordance with the present invention with its adjacent modules.

Although not shown in FIG. 3, it will be appreciated that the second end 270 will be similar to second end 270' of module 200' as shown in FIG. 5. Ideally, the ends 260, 270 of each luminaire module are identical, but complementary to one another, so that the same module connector can be used to hold the two luminaire modules together as will be described in more detail below with reference to FIG. 5.

Figure 4:
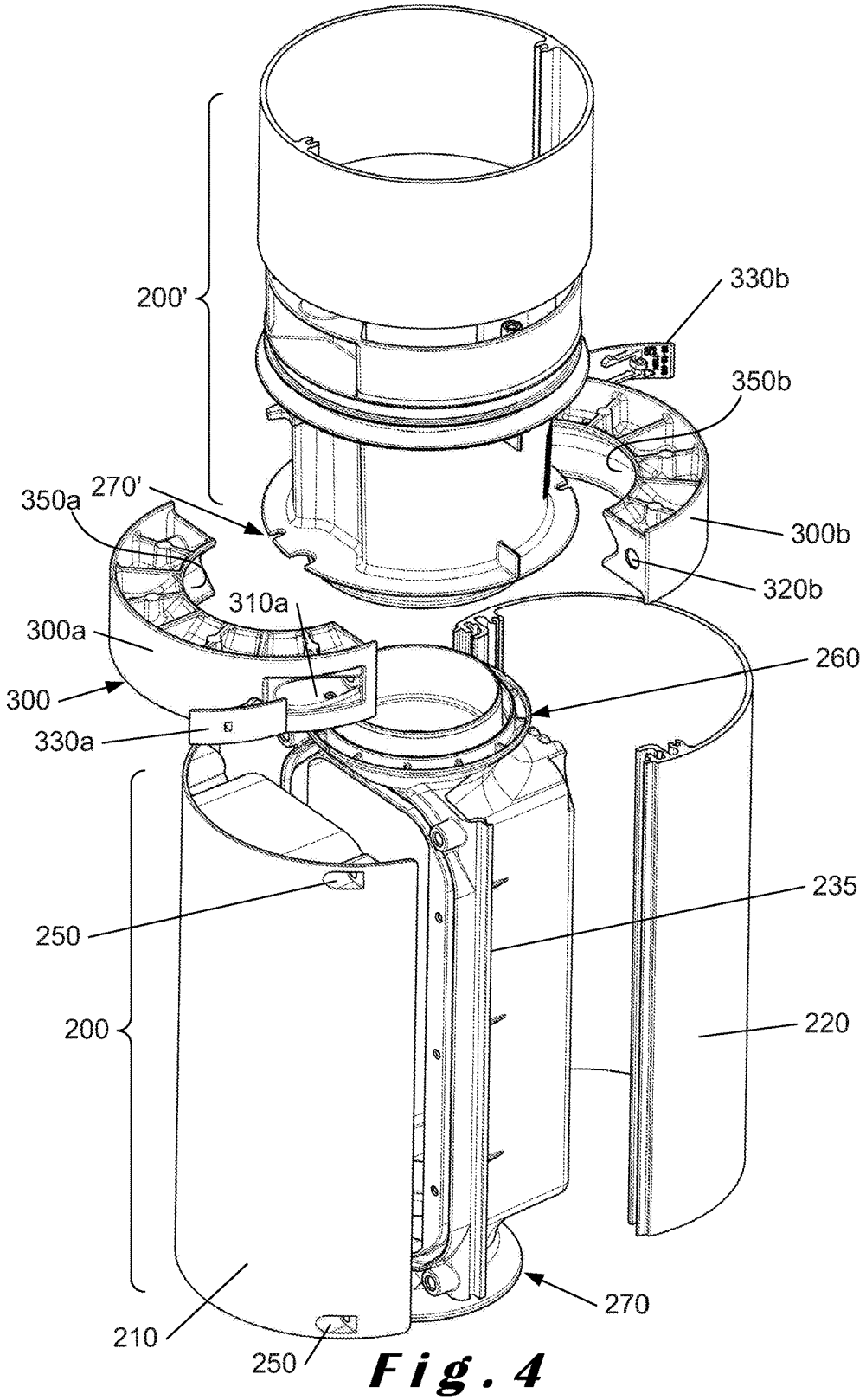
FIG. 4 illustrates an exploded view of the two modules and module connector shown in FIG. 3.

FIG. 4 illustrates an exploded view of the module 200 shown in FIG. 3 together with an additional module 200' mounted on top end 260 thereof. Components previously described with reference to FIG. 3 have the same reference numerals. As described above with reference to FIG. 3, the two portions 210, 220 which form the casing for the module 200 are shown as two separate components which are joined together to form longitudinal seals 230, 240 (FIG. 3) with the longitudinal gasket- or seal-retaining grooves 235, 245 making the casing water-tight. However, it will readily be understood that other means are also provided for ensuring that the functional components of each luminaire module is fully water-tight.

It will readily be appreciated that the two portions of the casing may be joined together by a hinge which effectively forms one seal with the other edges of the casing portions being joined together and made water-tight with a single longitudinal gasket- or seal-retaining groove.

A generic module connector 300 is shown in FIG. 4. The module connector 300 comprises a first connector portion 300*a* and a second connector portion 300*b* which, when connected together, compress the complementary interfaces 265, 275' formed at the first end 260 of the module 200 and the second end 270' of the module 200' to form a water-tight seal as will be described in more detail below with reference to FIG. 5.

Connector portion 300*a* includes a cut-out 310*a* which is adapted to receive a screw or bolt (not shown) for engaging with a corresponding threaded hole 320*b* in connector portion 300*b* to clamp the two portions together. A cover 330*a* is provided for closing the cut-out 310*a* once the two connector portions 300*a*, 300*b* have been connected together. Similarly, connector portion 300*b* includes a cut-out (not visible) which is adapted to receive a screw or bolt (not shown) for engaging with a corresponding hole (also not visible) in connector portion 300*a* to clamp the two portions together. A cover 330*b* is provided for closing the cut-out in the connector portion 300*b* once the two connector portions 300*a*, 300*b* have been connected together.

In addition, each connector portion 300*a*, 300*b* has an internal surface 350*a*, 350*b* which clamps the engaged complementary interfaces of the second end 270' of the second module 200' and the first end 260 of the first module 200.

The module connector 300, when tightened, provides an applied force or pressure in one direction to the complementary connector portions or interfaces, the applied force or pressure being effectively converted to a clamping force or pressure in a direction substantially perpendicular to the applied pressure, for example, a horizontally applied force or pressure is converted to a substantially vertical clamping force or pressure.

Whilst the hole 320*b* is preferably a threaded hole, it will readily be appreciated that the hole may be a simple hole which is engaged by a self-tapping screw or bolt. In addition, the hole 320*b* may comprise a threaded insert which is sized to receive a corresponding screw or bolt.

In addition, although only one cut-out and one associated hole is shown in FIG. 4 together with an associated screw or bolt (not shown), it will readily be appreciated that more than one screw or bolt may be provided in each cut-out with a corresponding hole provided for reception of each screw or bolt, or more than one cut-out may be provided for accommodating the screw or bolts.

Although the module connector 300 is described as comprising two connector portions 300*a*, 300*b*, it will readily be appreciated that the two connector portions may be formed as a single piece with a flexible hinge linking to the two connector portions together. In this case, only one screw or bolt will be required to close the module connector around the complementary interfaces of the luminaire modules to be connected and to provide the requisite pressure to clamp the two interfaces together.

The module connectors may be different for each pair of modules to be connected. However, it is preferred that the same module connector is used for all pairs of modules. Moreover, the first and second connector portions are preferably identical so that turning one of the connector portions through 180 degrees with respect to the other provides the other connector portion as shown in FIG. 4. In addition, the connector portions can be injection-moulded to make them lightweight and to reduce manufacturing costs.

Turning now to FIG. 5, a cross-sectioned view through the first and second ends 260, 270' of respective modules 200, 200' which have been connected together by module connector 300 is shown. First end 260 of module 200 is as described above with reference to FIG. 3 and is not described again in detail here. Second end 270' includes a second interface 275' which is formed by a first annular portion 275*a*' having a fifth diameter and a second annular portion 275*b*' separated from the first annular portion 275*a*' by an annular groove 275*c*', the annular portion 275*b*' having a sixth diameter which is greater than the fifth diameter and the annular groove 275*c*' having a diameter which is between the fifth and sixth diameters. The first and second annular portions 275*a*', 275*b*' are concentric with respect to the longitudinal axis of the module 200'. An annular gasket or seal 280' is provided in the annular groove 275*c*' to provide a seal between the first and second ends 260, 270' of respective modules 200, 200' as will be described in more detail below.

The concentric annular portions 275*a*', 275*b*' of interface 275' formed at the second end 270' of module 200' and the concentric annular portions 265*a*, 265*b* of interface 265 formed at the first end 260 of module 200 engage with one another so that:

annular portion 275*a*' fits around annular portion 265*a* (the fifth diameter being greater than the first diameter);

annular portion 275*b*' abuts annular shoulder portion 265*d* (the second diameter being substantially the same as the sixth diameter); and annular rim portion 265*d* projects into gasket or seal 280' thereby forming a seal between the first end 260 of the module 200 and the second end 270' of the module 200' (the fourth diameter being less than the second diameter but greater than the first and third diameters).

It will readily be understood that the engagement of the annular portion 275*a*' with the annular portion 265*a* aligns and centres the first and second ends 260, 270' due to the annular portion 275*a*' of the interface 275' and the annular portion 265*a* of the interface 265, and, the applied force or pressure to the module connector 300 provides a seal between the two modules 200, 200' by the engagement of the annular rim portion 265*d* with the gasket or seal 280' as described above.

As shown in FIG. 5, the module connector 300 has an external surface 340 and an internal surface defined by a first surface portion 350*a* and a second surface portion 350*b* (as shown in FIG. 4) of the connector portions 300*a*, 300*b*. Both the first and second surface portions 350*a*, 350*b* engage an external surface 275*d*' of the interface 275' of module 200' and an external surface 265*f* of the interface 265 of module 200, the external surfaces 275*d*', 265*f* being shaped to be define a shaped portion which is complementary to the internal surface defined by the first and second surface portions 350*a*, 350*b*.

The shaped portion defined by the external surface 275*d*' of interface 275' and the external surface 265*f* of interface 265 and formed by the engaged complementary interfaces 265, 275' is preferably an annular bi-cone. More preferably, the annular bi-cone so formed by the external surfaces 265*f*, 275*d*' is symmetrical about a contact plane between the complementary interfaces 265, 275'. In this case, the internal surfaces 350*a*, 350*b* of the two connector portions 300*a*, 300*b* also comprise an annular bi-cone but in relief as the internal surfaces 350*a*, 350*b* are complementary to the external surfaces 265*f*, 275*d*' as described above.

Whilst an annular bi-cone is a preferred shape for the shaped portion, with a complementary shape for the internal surfaces of the module connector (both the shape of the shaped portion defined by the external surfaces of the complementary interfaces and the complementary shape of the module connector being considered to be generated by a profile which has been through a 360-degree revolution), it will readily be appreciated that other annular shapes may be utilised instead, either symmetrical or asymmetrical about the contact plane between the complementary interfaces as described above. Naturally, module connectors having appropriate complementary shapes could also be used.

However, providing an adequate seal between the two interfaces may be prove to be difficult in some configurations as an insufficient clamping force or pressure will be transferred from the applied force or pressure due to the tightening of the screws or bolts within the module connectors to the external surfaces of the complementary interfaces.

It will readily be appreciated that a symmetrical annular shape is preferred from the point of view of the module connector where the possibility of using one connector portion which can be rotated with respect to the other to form a complete module connector when joined together as described above.

When modules 200, 200' are being assembled, interface 275' of module 200' is placed into engagement with interface 265 of module 200 as described above with the annular portion 265*a* of the interface 265 being centred within the annular portion 275*a*' of the interface 275', and, the two connector portions 300*a*, 300*b* of the module connector 300 are clipped over the shaped portion defined by the external surface 275*d*' of interface 275' and external surface 265*f* of interface 265, joined together and tightened to clamp the complementary interfaces 265, 275' together. As described above with reference to FIG. 4, the two connector portions 300*a*, 300*b* are then joined using screws or bolts (not shown) which are inserted into cut-outs 310*a* in each connector portion (310*b* not visible in FIG. 4) and screwed into holes 320*b* in the other connector portion (320*a* also not visible in FIG. 4).

As shown in FIG. 5, the modules and the module connectors are sized so as to have substantially the same external diameter so that a substantially even circumferential surface is provided over the surface of the modular luminaire with little or no spaces between the casing of a module and the external surface of a module connector. This assists in the prevention if ingress of water into any spacing between the module connector and the modules themselves. As described above, the annular rim 265*d* and the gasket or seal 280 effectively seals the junction between modules and the module connector fixes the two modules in place with respect to one another.

Although not shown, a module connector 300 may also be used for connecting a module 200 to the top of a supporting pole 110 as shown in FIG. 1. Here, the top of the supporting pole 110 has an interface which is similar to interface 265 of module 200 as described above with reference to FIGS. 3 to 5. The mounting of such a module 200 is essentially the same as the mounting of module 200' on module 200 as described above with reference to FIGS. 4 and 5 with electrical connections passing through the supporting pole 110 to the module 200 mounted thereon. A module connector 300 is also used to make the connection between the top of the supporting pole 110 and the module 200 secure and water-tight in a similar way to described above with reference to FIGS. 4 and 5.

Figure 6:
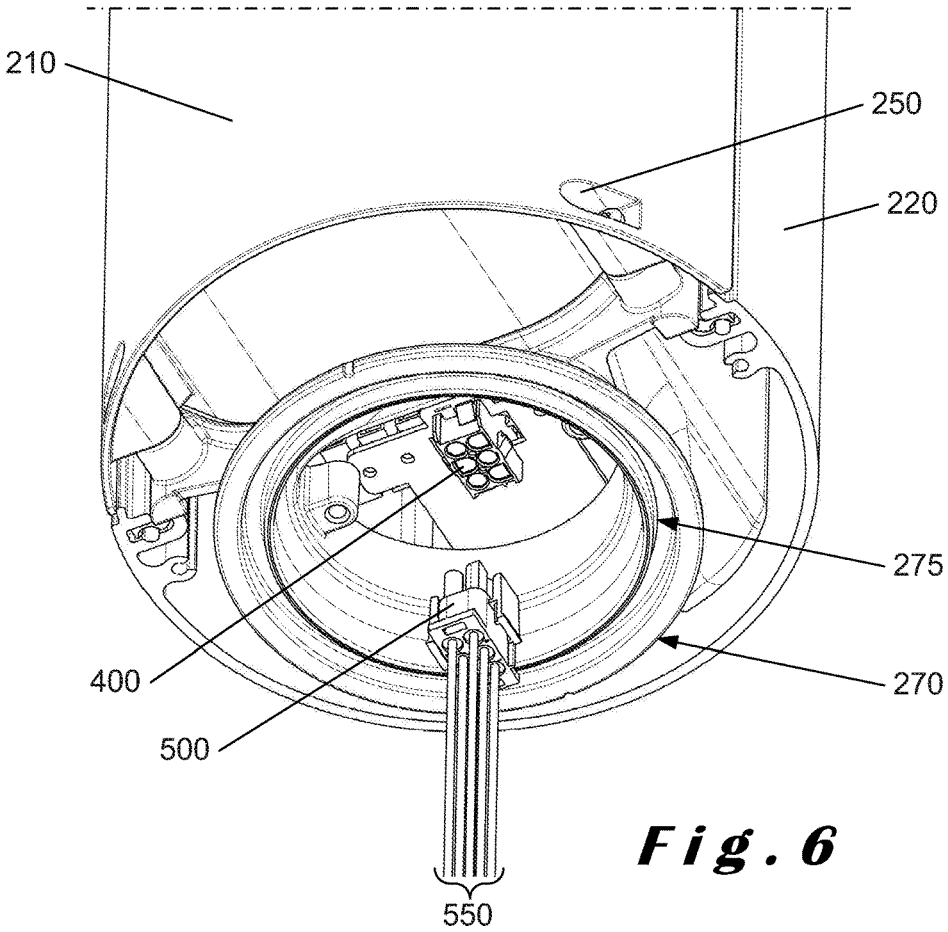
FIG. 6 illustrates a perspective view of the underside of the module shown in FIG. 2.

FIG. 6 illustrates the second end 270 of module 200 in which a plug-in electrical connector 400 is shown fixed within the module 200. A complementary plug-in electrical connector 500 is intended to engage with plug-in electrical connector 400 to provide electrical connections both to components within the module (not shown) and to components in a module 200', for example, on the other side of the module 200 (as shown in FIG. 4). In some instances, not shown, electrical connections may be a single wire or conductor which passes through all modules, for example, coaxial cabling for which the connectors are expensive. Naturally, each module through which any electrical connections need to pass has appropriate passageways provided therein (not shown).

The complementary plug-in electrical connector 500 is connected to a plurality of electrical connections 550. Although the connectors 400, 500 show six possible electrical connections, it will readily be appreciated that any suitable number of connections may be provided.

Figure 7:
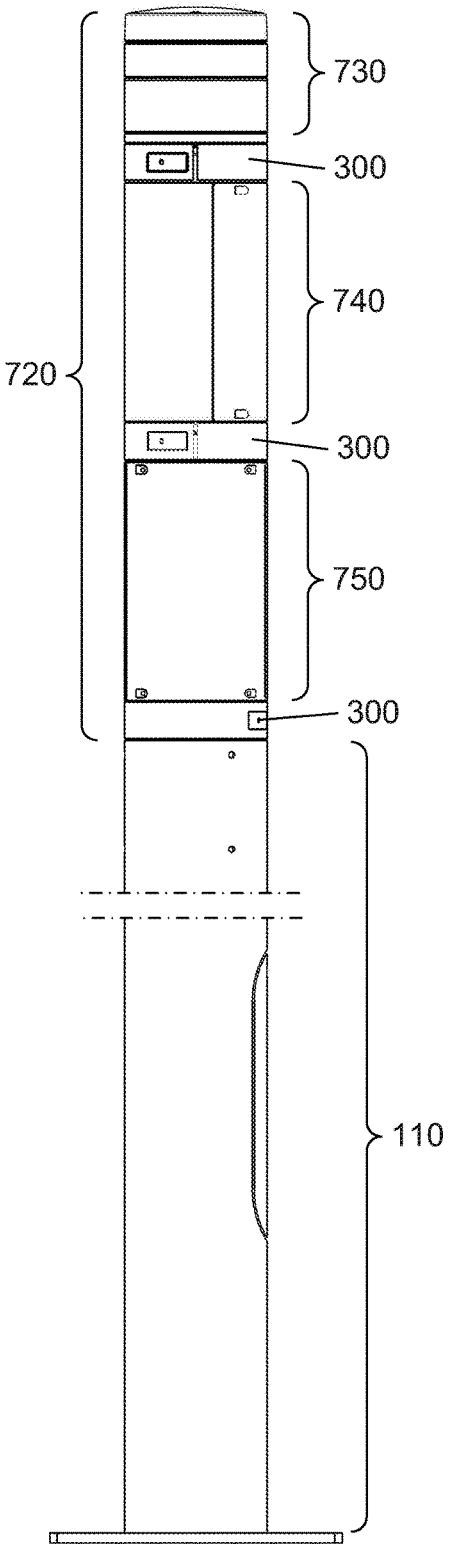
FIGS. 7 and 8 are similar to FIG. 1 but illustrating respective different modular luminaire assemblies in accordance with the present invention.
Figure 8:
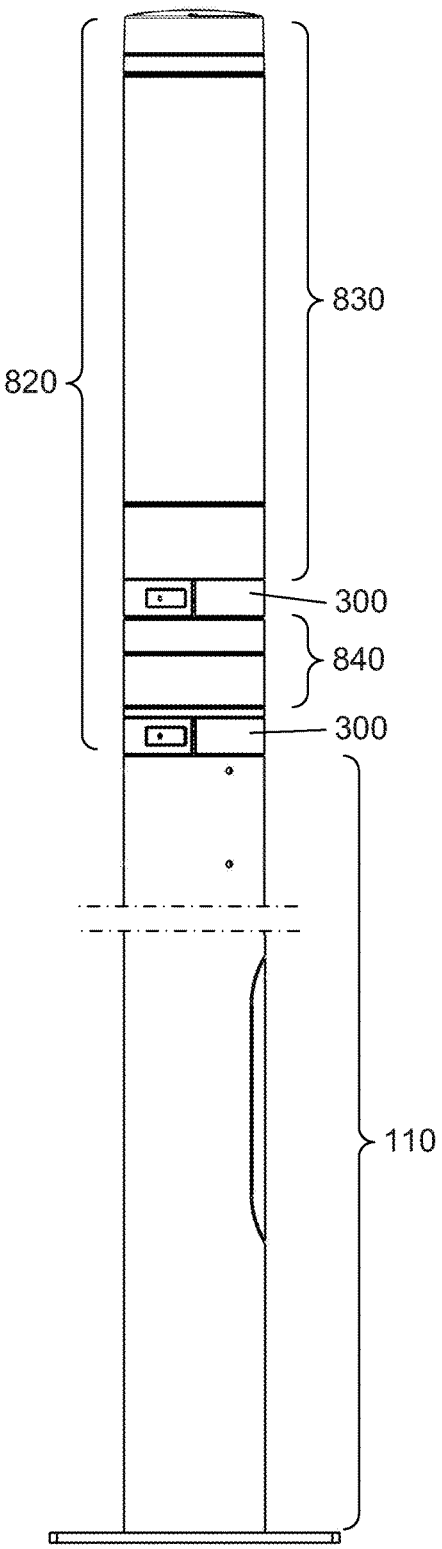

FIGS. 7 and 8 illustrate other modular arrangements in which the modules are arranged in a different order. In FIG. 7, a modular luminaire assembly 700 is shown which comprises a supporting pole 110, as described above with reference to FIG. 1, on which is mounted a plurality of modules 720. In this embodiment, the plurality of modules comprises three modules 730, 740, 750 connected together and to the supporting pole 110 by module connectors 300. Modules 730 and 750 comprise modules whose functionality has not been previously described, and module 740 is similar to module 140 shown in FIG. 1.

Similarly, in FIG. 8, a modular luminaire assembly 800 is shown which comprises a supporting pole 110, as described above with reference to FIG. 1, on which is mounted a plurality of modules 820. In this embodiment, the plurality of modules comprises two modules 830, 850 connected together and to the supporting pole 110 by module connectors 300. Module 830 and 850 are similar to modules 130 and 150 as shown in FIG. 1.

In an embodiment of the invention, the supporting pole 110 may be replaced by any other supporting means, for example, a mounting point on a surface like a wall.

In an embodiment of the invention, the luminaire modules 130, 140, 150 are mounted to each other in a vertical direction. In another embodiment of the invention, the luminaire modules 130, 140, 150 may be mounted to one another in a horizontal direction.

Naturally, any suitable number of modules may be connected together, particular modules being chosen for their functionality. In the field, that is when a modular luminaire assembly is being assembled and installed, engineers carrying out the assembly and subsequent installation can easily:

select modules as required;

electrically connect the selected modules together using the plug-in electrical connectors (as described above with reference to FIG. 6);

pass coaxial cabling through each module for a module providing antenna functionality (typically modules 130, 830 as described above with reference to FIGS. 1 and 8);

engage each module with at least one adjacent module, as appropriate, using interfaces formed at respective first and second ends of each module (as described above with reference to FIGS. 3 to 5);

physically connect adjacent modules together using the module connectors (as described above with reference to FIGS. 4 and 5); and physically connect the lowermost module to the top of the supporting pole using a module connector (as described above with reference to FIGS. 4 and 5).

The modularity of the luminaire assembly described herein has several additional advantages.

The easy removal of the luminaire module at the top of the modular luminaire assembly 100 (first luminaire module 130 in FIG. 1) provides an efficient way to make replacement of this luminaire module in the field, for example if this luminaire needs to be removed for maintenance or replaced for product evolution.

The removal of a module and placement of a new module is quick, which prevents substantial down-time for the other modules.

Modules are interchangeable.

A module having a new or a specific function can easily be added or replace another module.

A luminaire assembly can include at least one empty module for maintaining the overall aesthetic consistency with adjacent luminaires. For example, the luminaires may all have the same height even though they may have different functionalities.

Naturally, any other suitable assembly of luminaire modules is possible and is not limited to the specific examples described herein.

What is claimed is:

1. A modular luminaire assembly comprising:

a luminaire module comprising an interface formed at an end thereof, said interface having a surface, said interface being configured for engaging with a complementary interface having a surface, so that the respective surfaces define a shaped portion; and a module connector for connecting said complementary interfaces, said module connector having a surface shaped to be complementary to the shaped portion formed by said surfaces of the engaged complementary interfaces;

wherein the module connector is configured to apply pressure in a first direction when the module connector is tightened against the surfaces of the engaged complementary interfaces; and wherein the surface of the module connector is configured to convert the pressure applied in the first direction to a clamping pressure in a second direction, the second direction being substantially perpendicular to the first direction.

2. The modular luminaire assembly according to claim 1, wherein the interface includes a seal which is engaged by a portion of the complementary interface.

3. The modular luminaire assembly according to claim 1, wherein the shaped portion formed by the complementary interfaces is symmetrical about a contact plane between the complementary interfaces.

4. The modular luminaire assembly according to claim 1, wherein the shaped portion defines an annular bi-cone shape of the surfaces of the complementary interfaces.

5. The modular luminaire assembly according to claim 1, wherein the connector module further comprises at least one fixing element arranged for clamping together the surface of the connector module and the surfaces of the shaped portion formed by the engaged complementary interfaces.

6. The modular luminaire assembly according to claim 5, wherein the connector module comprises first and second connector portions which are held together, around the shaped portion formed by the surfaces of the complementary interfaces, by at least two fixing elements passing through one connector portion and into the other connector portion.

7. The modular luminaire assembly according to claim 6, wherein the first and second connector portion have at least one aperture through which a fixing element passes and a corresponding hole into which the fixing element engages, respectively.

8. The module connector according to claim 7, wherein the first and second connector portions are identical and one of the first and second connector portions is rotatable with respect to the other connector portion to form the connector module and for receiving the fixing elements.

9. The modular luminaire assembly according to claim 1, wherein the first and second connector portions are integrally formed with a flexible hinge located between the first and second connector portions, the first and second connector portions being held together around the shaped portion formed by the surfaces of the complementary interfaces by at least one fixing element which passes through the first connector portion and into the second connector portion.

10. The modular luminaire assembly according to claim 1, wherein the luminaire module comprises a second interface at a second end thereof, said second interface being configured for engaging with a second complementary interface having a surface, so that the respective surfaces define a shaped portion; and a second module connector for connecting said complementary second interfaces, said module connector having a surface shaped to be complementary to the shaped portion formed by said surfaces of the engaged complementary second interfaces.

11. A luminaire comprising:

a luminaire module comprising at a first end thereof a first interface having a surface;

a support pole including a second interface, the second interface being complementary to the first interface and having a surface, wherein the complementary first and second interfaces are operable for engaging with one another so that their respective surfaces define a shaped portion; and a module connector configured for connecting the luminaire module to the support pole, said module connector having a surface shaped to be complementary to the shaped portion formed by the surfaces of the engaged complementary first and second interfaces, said module connector being configured to apply pressure in a first direction when the module connector is tightened against the surfaces of the engaged complementary first and second interfaces, wherein the surface of the module connector is configured to convert the pressure applied in the first direction to a clamping pressure in a second direction, the second direction being substantially perpendicular to the first direction.

12. The luminaire according to claim 11, wherein the luminaire module comprises at a second end thereof a second interface, wherein the luminaire further comprising a second luminaire module comprising a first interface being complementary to the second interface of the luminaire module, wherein the complementary second and first interfaces are operable for engaging with one another so that their respective surfaces define a second shaped portion, wherein the luminaire further comprises a second module connector configured for connecting the luminaire module to the second luminaire module, said second module connector having a surface shaped to be complementary to said second shaped portion.

13. The luminaire according to claim 11, wherein the complementary surface of the module connector is rotation-symmetrical around an axis of the luminaire.

14. The luminaire according to claim 11, wherein the connector module further comprises at least one fixing element arranged for clamping together the surface of the connector module and the surfaces of the shaped portion formed by the engaged complementary interfaces.

15. A luminaire comprising:

a first luminaire module comprising at a first end thereof a first interface having a surface;

a second luminaire module including a second interface, the second interface being complementary to the first interface, wherein the complementary first and second interfaces are operable for engaging with one another; and a module connector configured for connecting the first luminaire module to the second luminaire module around the first and second interface, wherein the first luminaire module comprises a passageway between the first end and a second end thereof;

said passageway passing through the first interface of the first luminaire module and allowing cabling to pass to the second luminaire module.

16. The luminaire according to claim 15, wherein the first interface comprises a circular opening delimiting the passageway through the first luminaire and the second interface comprises a complementary circular opening delimiting a passageway through the second luminaire module.

17. The luminaire according to claim 15, wherein the first interface includes a seal which is engaged by a portion of the second interface.

18. The luminaire according to claim 15, wherein the shaped portion formed by the first and second interfaces is rotation-symmetrical about an axis of the luminaire.

19. The luminaire according to claim 15, wherein the first interface of the first luminaire module comprises a first annular portion and a second annular portion separated by an annular groove, and the interface of the second luminaire module comprises another annular portion arranged to engage with the annular groove when the first and second luminaire module are mounted together.

20. The luminaire according to claim 15, wherein the connector module further comprises at least one fixing element arranged for clamping together the surface of the connector module and the surfaces of the shaped portion formed by the engaged complementary interfaces.

* * * * *